United States Patent [19]

Harwath

[11] Patent Number: 4,504,815

[45] Date of Patent: Mar. 12, 1985

[54] MINIATURE FUSEHOLDER

[75] Inventor: Frank A. Harwath, Berwyn, Ill.

[73] Assignee: Allied Corporation, Morris Township, Morris County, N.J.

[21] Appl. No.: 446,157

[22] Filed: Dec. 2, 1982

[51] Int. Cl.[3] ..... H01H 85/02

[52] U.S. Cl. ..... 337/201; 337/213; 339/147 R

[58] Field of Search ..... 337/201, 213, 194, 190, 337/206, 208; 339/147, 255 R

[56] References Cited

U.S. PATENT DOCUMENTS

| | | | |
|---|---|---|---|
| 3,243,550 | 3/1966 | Hollins | 337/201 |
| 3,243,551 | 3/1966 | Hollins | 337/213 |
| 3,286,061 | 11/1966 | Henderson | 337/206 |
| 3,828,291 | 8/1974 | Urani | 337/201 |
| 3,832,674 | 8/1974 | Florian | 339/255 |
| 4,329,006 | 5/1982 | Gale | 337/213 |

*Primary Examiner*—Harold Broome

[57] ABSTRACT

A fuseholder of the bayonet-type for retaining tubular fuses is provided with a cap insert having a radial projection adjacent its open end, and a radially-projecting tab means adjacent its open end. The projection and tab cooperate with a body contact having a tip portion and a notch, the tab latching in the notch, and the radial projection bearing against the tip portion, so that electrical continuity is not lost if the cap portion of the fuseholder is accidentally depressed. A symmetrical spring means having a central portion and identical reduced-diameter end portions may be used in such a fuseholder, and simplifies the assembly of the fuseholder by eliminating the necessity for a predetermined endwise alignment of the spring at assembly.

9 Claims, 14 Drawing Figures

MINIATURE FUSEHOLDER

BACKGROUND OF THE INVENTION

Various types of fuseholders for retaining tubular fuses are well-known, and commercially available. Conventionally, separate fuseholders are used for retaining the style of fuses commonly used in the United States, and for retaining the smaller type of fuse used internationally throughout much of Europe and other countries. Thus, it has been necessary to construct equipment having different fuseholders for sale in different countries, and, if it is decided to sell a completed item in a country other than the ones whose requirements it was intended to meet, the original fuseholder must be removed and a different fuseholder substituted.

Also, conventional fuseholders are subject to a loss of electrical continuity, sometimes known as "doorbelling" when a cap member of a bayonet-type fuseholder is depressed, since the bayonet fastening means also serves to establish electrical connection, with a spring that forces the fuse into proper electrical contact also serving to maintain the latching elements of the bayonet latch in physical contact. When the cap member is depressed, the force of this spring is overcome, and the latching members move away from each other. While rotation of the cap is necessary to remove the cap from the body portion, electrical continuity is interrupted without rotation. Accidental breaking of electrical contact either due to accidental depression of the fuseholder cap or due to depression of the fuseholder cap without knowledge of the consequences may present a serious problem in complex equipment, such as a computer or an item including digital logic whose present state depends on a long and complex history of previous states, or in storage means such as disk drives where the read-write head is supported on a thin film of air generated by the rapidly spinning storage disk. Interruption of electrical continuity due to depressing a fuseholder cap may cause slowing of the storage disk, resulting in the read-write head contacting the storage disk, destroying the storage disk and the read-write head.

The instant invention overcomes these and other deficiencies of the prior art.

SUMMARY OF THE INVENTION

It is a primary object of the invention to provide a fuseholder for a tubular fuse element having first and second end ferrules and an intermediate insulating body, having a cap portion, a body portion having a first closed end and a second open end, the second open end being adapted to receive and removably retain the cap portion, the body portion including first electrically conductive contact means adjacent the first closed end for establishing electrical connection to the first end ferrule, the cap portion including electrically-conductive insert means for establishing electrical connection to the second end ferrule, the insert means including at least one radial projection adjacent an open end, and a radially-projecting tab adjacent the radial projection. The body portion includes second contact means for establishing electrical connection to the insert, the second contact including a terminal portion and a tip portion and defining a notch therebetween, the notch being adapted to receive the radially projecting tab means of the insert, the tip portion being adapted to maintain electrical connection between the tip portion and the radial projection of the insert means when the tab is received in the notch, and having spring means for urging the tab towards a first edge of the notch.

It is an advantage of the invention that electrical continuity is maintained when the fuseholder cap portion is moved longitudinally with respect to the fuseholder body portion.

It is a further objective of the invention to provide a fuseholder with a spring for urging the radially-projecting tab against the first edge of the notch, the spring being a helical spring having first and second end portions and an intermediate portion, the first and second end portions being a smaller outside diameter than the outside diameter of the intermediate portion, the first and second end portions being equal in outside diameter, so that the spring may be inserted manually without care as to its endwise orientation, or may be easily inserted by automated equipment, since the orientation of the ends is now immaterial.

Other objectives, features, and advantages of fuseholders according to the invention will become apparent from the detailed description which follows.

DESCRIPTION OF THE PREFERRED EMBODIMENTS

Figure 1:
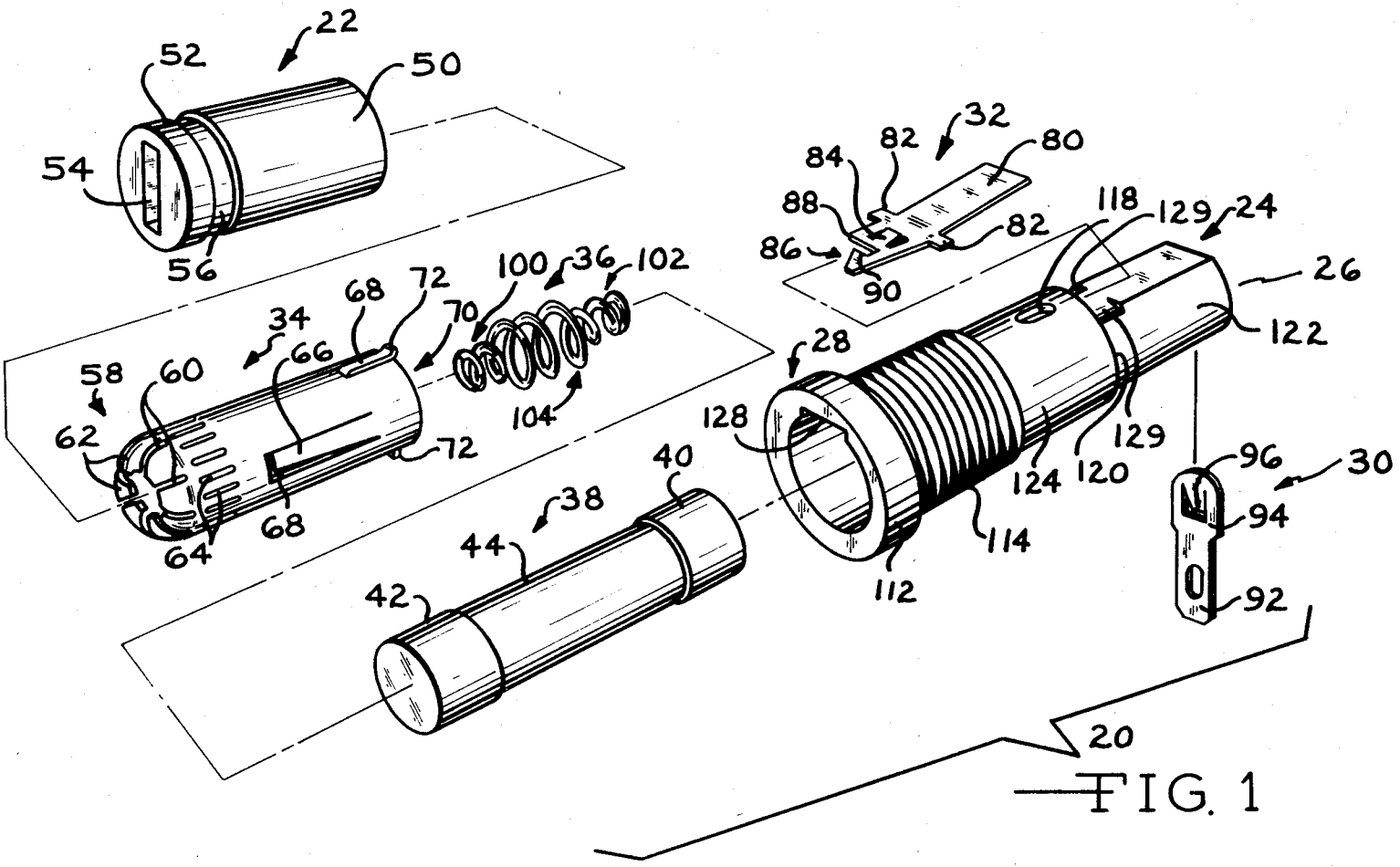
FIG. 1 shows an exploded view of a fusheholer according to a first embodiment of the invention, adapted to receive a United States standard fuse.

As stated above, the drawing figures illustrate five different preferred embodiments of miniature fusheholders according to the invention. The first of these embodiments is shown in FIGS. 1–4. As shown in the exploded view of FIG. 1, fuseholder 20 includes a cap portion 22, a body portion 24 having a first closed end 26, a second open end 28 and a first contact means 30 adapted to be disposed partially within first closed end 26. Body portion 22 also includes a second contact means 32. Cap portion 24 is provided with a conductive insert 34 and a spring means 36. Fuseholder 20 retains a fuse 38, having a first end ferrule 40 and a second end ferrule 42 and an intermediate insulating body 44.

Cap portion 22 is shown as having a tubular body 50 and a head portion 52 having a screwdriver slot 54. A circumferential groove 56 is provided to facilitate manually grasping cap portion 22. Conductive insert 34 is may be inserted into tubular body 50 either during the molding of body 50 from a nonconductive plastic material, or while the material of body 50 is still warm. Preferably, insert 34 is inserted after cooling of body 50, since body 50 is preferably formed of a conventional insulating plastic, which has adequate resilience to allow insertion of insert 34 at this time. Insert 34, in this embodiment, is shown as being generally tubular in shape having a partially closed rounded end 58, may be forming slots 60 and bending tip portions 62 radially inwardly. This facilitates the insertion of member 34 into body 50. Insert 34 is also shown as provided with a plurality of slots 64, which are intended to cooperate with the material of tubular body 50 to retain insert 34 in body 50 and resist torque applied to insert 34. Insert 34 is also shown as provided with an integrally-formed finger member 66, made by forming a U-shaped slot 68 in the material of insert 34, and deflecting finger 66 inwardly, to retain ferrule 42 of fuse 38 in insert 34.

As will be explained more fully below, conductive insert 34 includes a radial projection 68 adjacent open end 70, and a radially-projecting tab means 72 adjacent radial projection 68. Radial projection 68 may be formed by shearing and bending the material of conductive insert 34, or by deforming the material of conductive insert 34, and bending the end of the deformed section radially outward. Radially-projecting tab means 72 serves as a part of a bayonet-type retaining means for cap portion 22, and radial projection 68 serves to prevent loss of electrical contact if cap portion 22 is accidentally depressed.

Second contact means 32 includes a terminal portion 80, adapted to be connected to external wiring, and preferably in the form of a conventional quick-connect terminal portion, a pair of stop members shown as tabs 82 for limiting the insertion and removal of member 32 in body portion 22, a latching finger 84 for retaining member 32 in body portion 24, a tip portion 86 for cooperating with radial projection 68, and a notch 88, for cooperating with radially-projecting tab means 72 and having a first edge 90.

First contact means 30 has a terminal portion 92, shown in the form of a conventional quick-connect terminal, and a contact area 94, including a latching finger 96, for retaining first contact means 30 in body portion 24 adjacent first closed end 26. Spring means 36 is shown disposed in cap portion 22, for urging fuse 38 towards contact means 30. However, as will be apparent, such a spring means may also be disposed in body portion 24, for the same purpose and with the same effect. Spring means 36 is shown as including a first end portion 100, a second end portion 102 and an intermediate portion 104. As illustrated, end portions 100 and 102 have identical outside diameters, which are smaller than the outside diameter of intermediate portion 104. Thus, as can be seen, spring 36 is symmetrical, facilitating its handling during assembly, so that no particular care need be used in insuring the correct orientation of spring 36. Previously, it was necessary to carefully orient each spring used for the purposes of spring 36, to insure that one of two ends was the leading end during insertion. Also, as will more fully appear below, and in the drawings, springs such as spring 36 will not become entangled during shipping and handling, or in a conventional vibratory feeder. Preferably, the reduced diameter end portions of spring 36 are formed with their terminal portions having at least one closed or solid-height turn.

Figure 2:
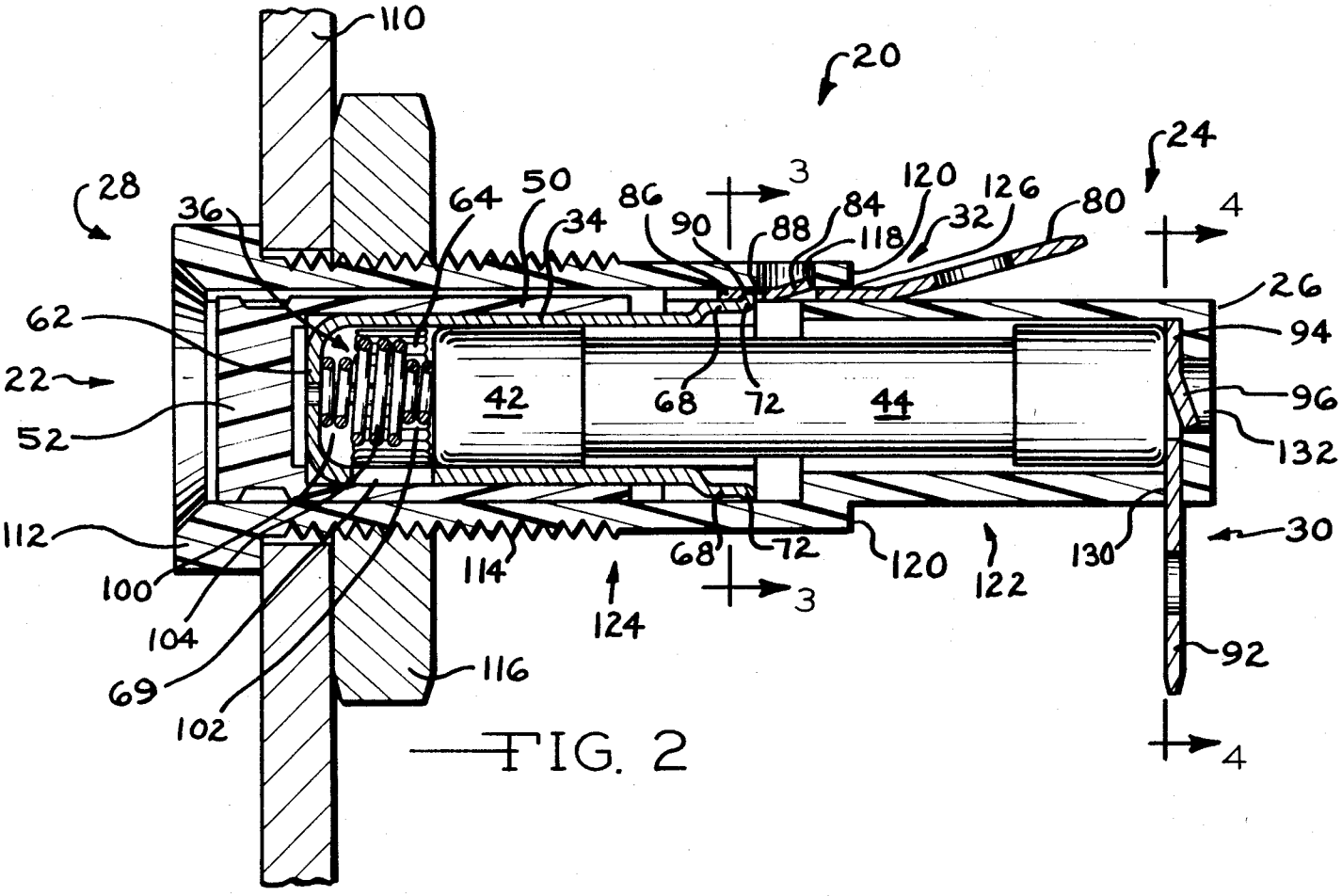
FIG. 2 shows a lengthwise sectional view of the fuseholder of FIG. 1.

In FIG. 2, fuseholder 20 is shown mounted to a panel 110. For this purpose, body portion 24 is provided with a flange portion 112 adjacent end 28, and a threaded portion 114 adjacent flange portion 112. A nut means 116 is shown cooperating with threaded portion 114 and flange portion 112 to retain fuseholder 20 to panel 110. As can also be seen in FIG. 2, second contact 32 is retained in body portion 24 by the cooperation of latching finger 84 with aperture 118, stop members 82 cooperating with a shoulder 120 separating a first portion 122 of body portion 24 adjacent end 26 from a second and larger portion 124 adjacent end 28. Thus, second contact member 32 is installed by simply pushing it into a slot 126 defined in shoulder 120 in alignment with groove 128. First portion 122 may also be provided with indented portions 129 for further cooperating with stop members 82 to retain contact member 32.

First contact member 30 is installed by pushing it into a slot 130 radially defined in first portion 122 adjacent end 26, until latching finger 96 engages aperture 132.

As may now be apparent, a fuse 38 would be inserted into cap portion 22, and for convenience retained by finger member 66 of insert 34. The combination of cap portion and fuse is then axially inserted into body portion 24, and rotated until tab means 72 engages a notch 88.

Figure 3:
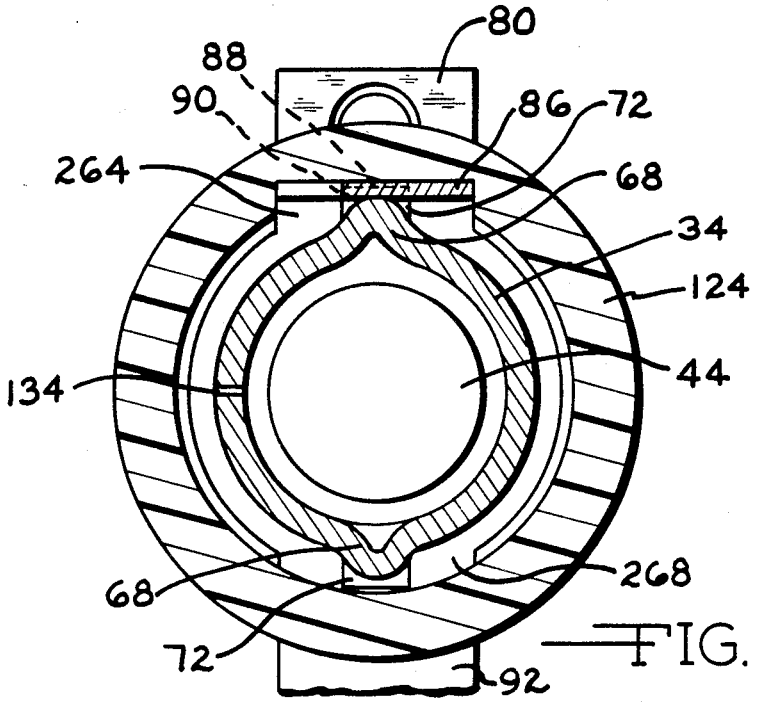
FIG. 3 shows a transverse sectional view of the fuseholder of FIG. 1, taken along line 3—3 in FIG. 2.
Figure 4:
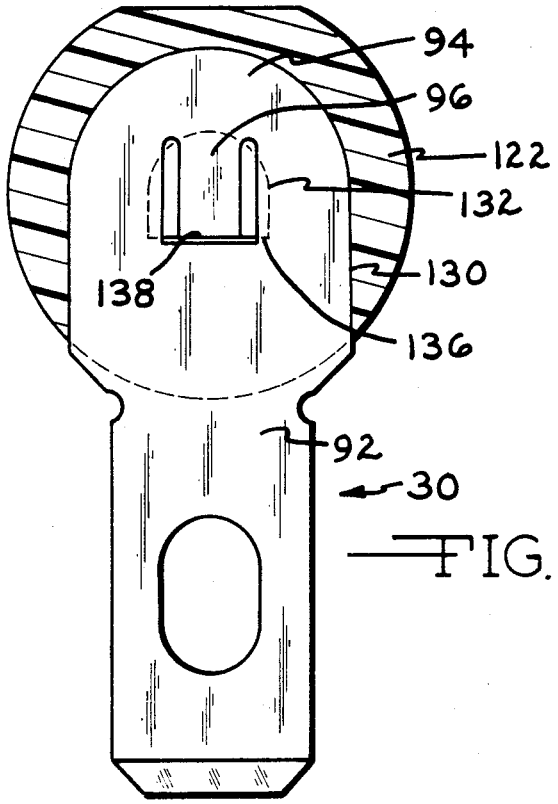
FIG. 4 shows a transverse sectional view of the fuseholder of FIG. 1, taken along line 4—4 in FIG. 2.

FIGS. 3 and 4 are sectional views taken along lines 3—3 and 4—4 respectively in FIG. 2. FIG. 3 shows that, in the preferred embodiment of the invention, conductive insert 34 is formed from a flat metallic sheet, rolled into a tubular form, and with a gap or seam line 134. It is also shown that radial projections 68 are preferably formed by deforming the metal of insert 34 outwardly, and bending the end of the deformed section radially outwardly to form tabs 72. As shown, radial projections 68 cooperate with tip portions 86 and resiliently maintain electrical contact with tip portions 86 even if tab means 72 is not in contact with first edge 90 of notch 88. In the embodiment of these figures, two tabs 72 and radial projections 68 are used.

In FIG. 4, it is shown that aperture 132 is a D-shaped aperture, defining a straight edge portion 136 for cooperating with tip portion 138 of latching finger 96.

Figure 5:
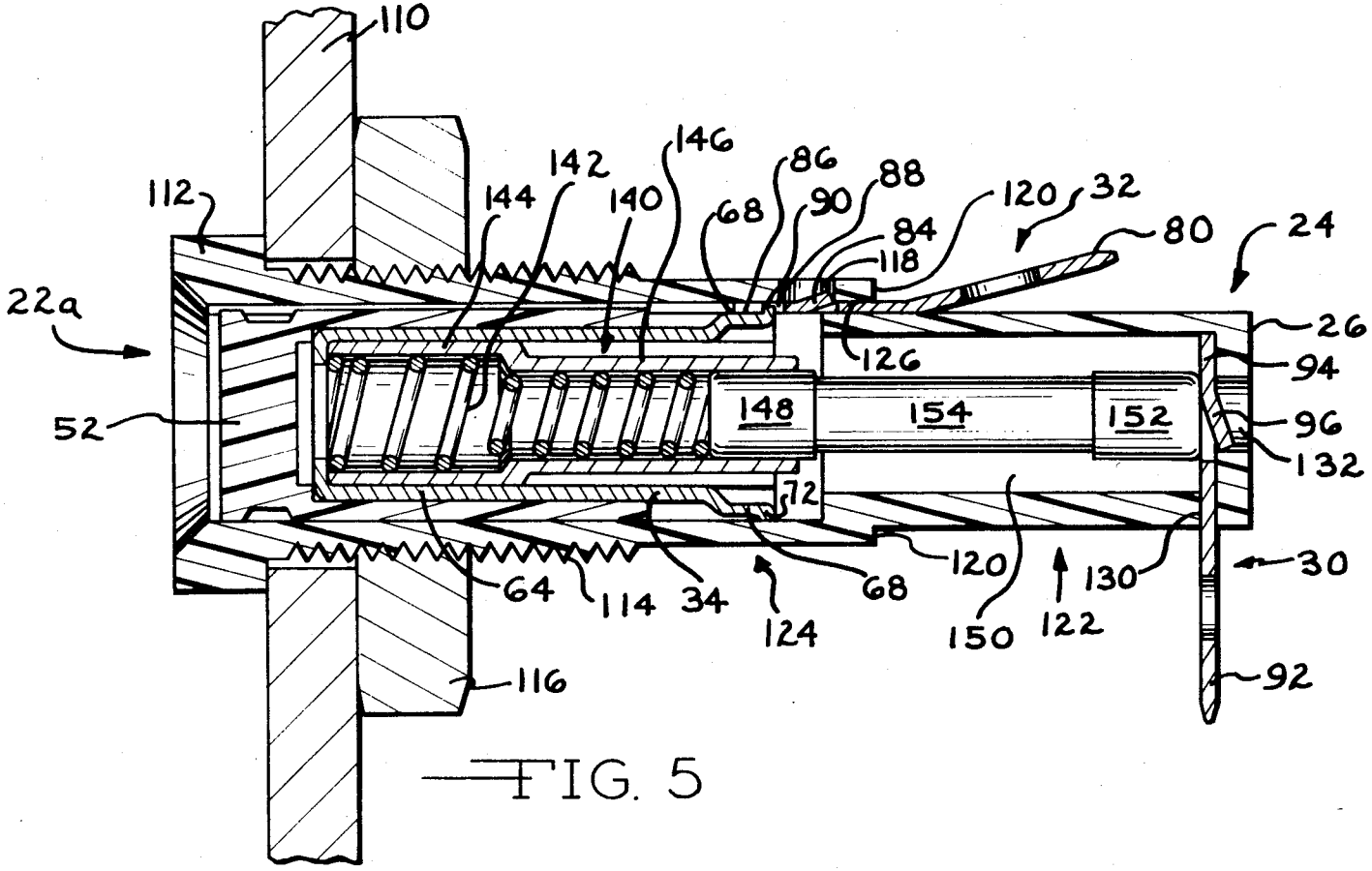
FIG. 5 shows a lengthwise sectional view of a fuseholder according to a second embodiment of the invention, adapted to receive a European or international standard fuse.

Turning now to the second preferred embodiment shown in FIG. 5, it will be noted that similar numbers are used for features which are common to the embodiment of the previous figures and to the second preferred embodiment. FIG. 5 shows a fuseholder according to the invention adapted to receive a European or international-type fuse, which is smaller than the tubular fuses typically used within the United States. The most significant difference between this embodiment of the invention and the first embodiment of the invention is the presence of an adapter means 140 and spring 142 within cap portion 22*a*. As illustrated, adapter means 140 has a first diameter portion 144 having an outside diameter adapted to be a force fit within insert 34, and a second diameter portion 146 having an inside diameter adapted to closely receive an end ferrule 148 of a fuse 150 having end ferrules 148 and 152 and an insulating body 154. Spring 142 is shown configured to match the inside diameters of first diameter portion 144 and second diameter portion 146. Thus, spring 142 is inserted into adapter means 140 before insertion of adapter means 140 into insert means 34, thus retaining spring 142 in place.

Figure 6:
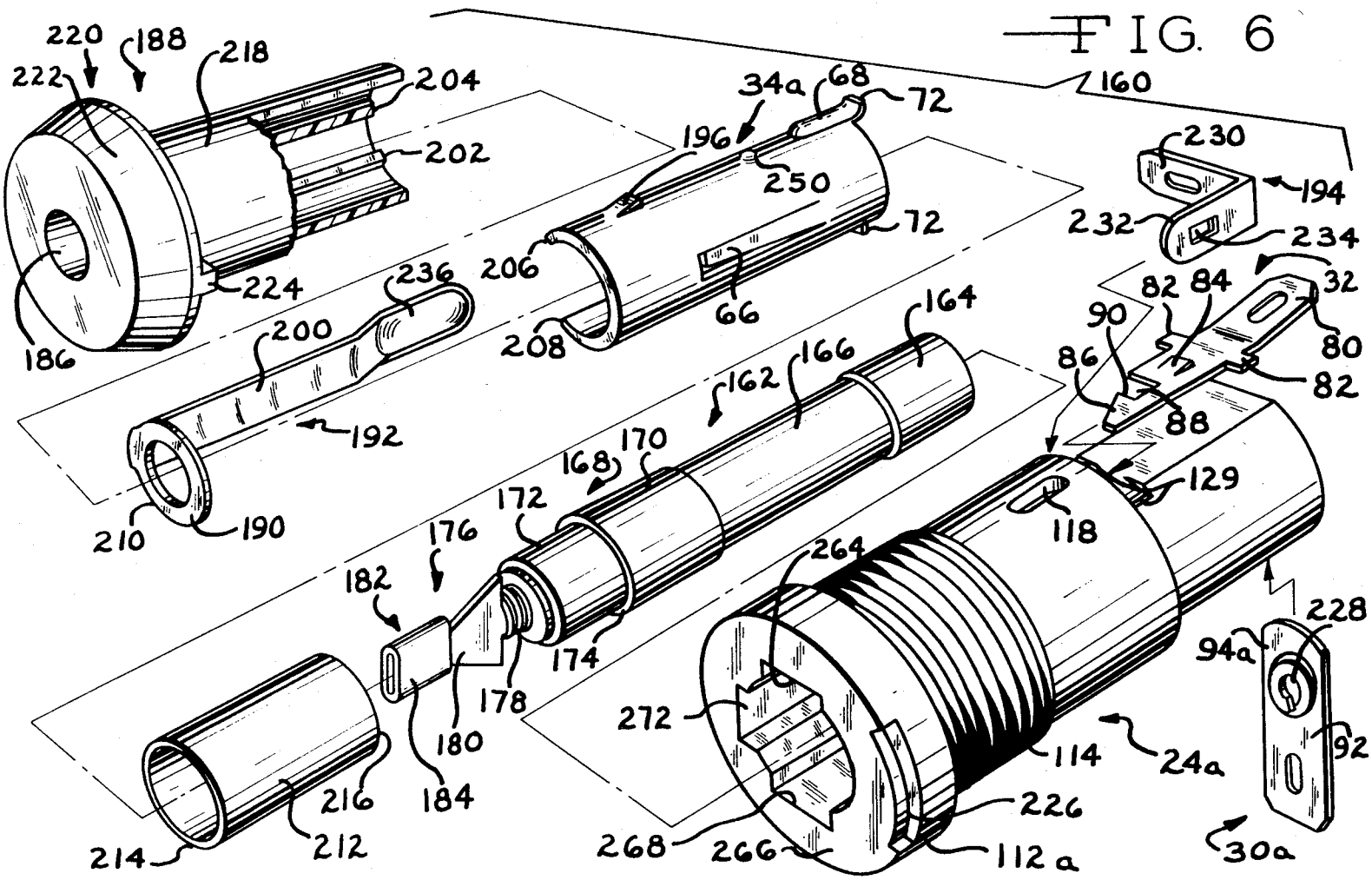
FIG. 6 shows an exploded view of a fuseholder according to a third embodiment of the invention, adapted to receive an indicating fuse and to provide a visual indication of fuse operation.
Figure 7:
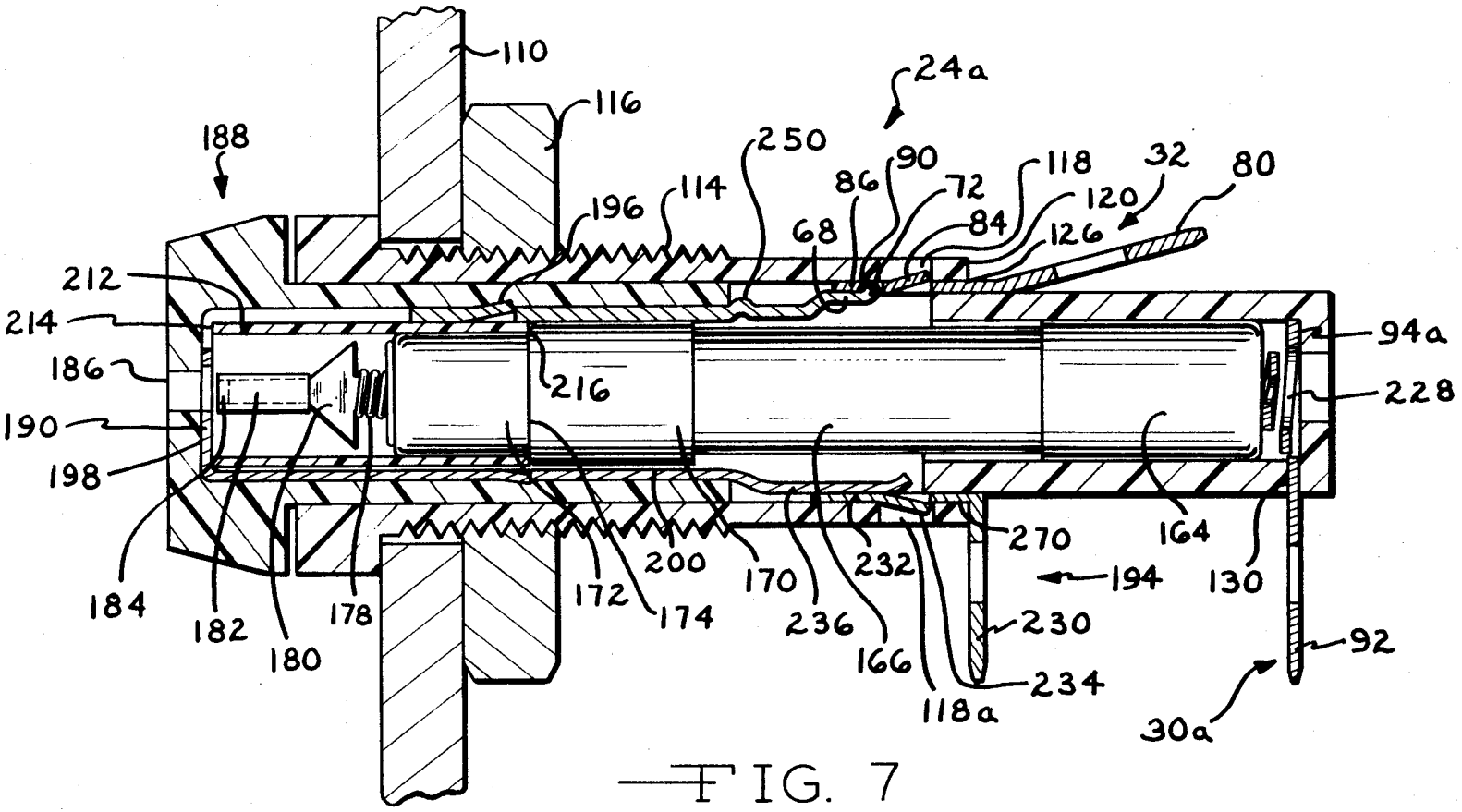
FIG. 7 shows a lengthwise sectional view of the fuseholder of FIG. 6.
Figure 8:
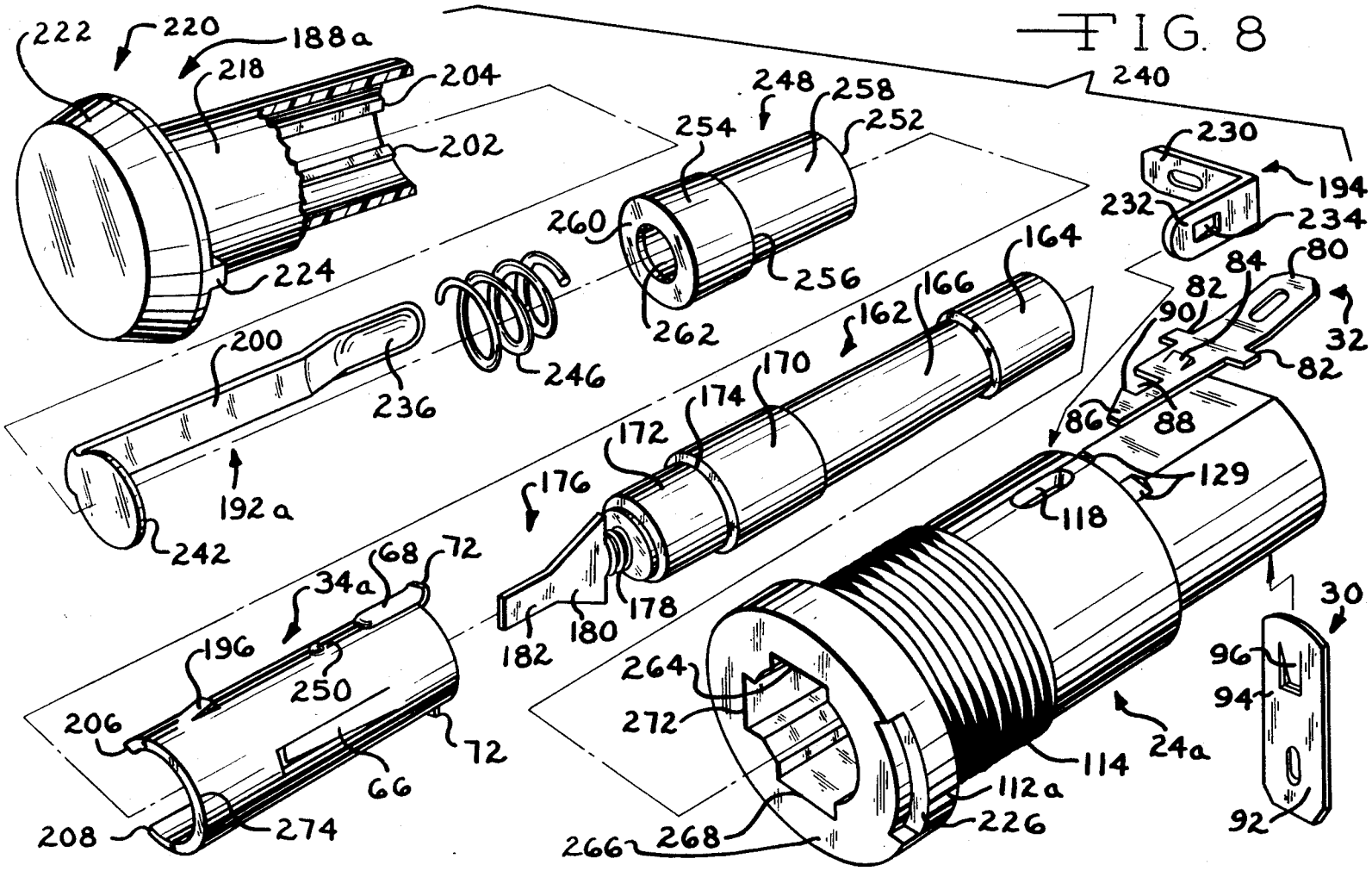
FIG. 8 shows an exploded view of a fuseholder according to a fourth embodiment of the invention, adapted to receive an indicating fuse and to provide an electrical indication of fuse operation.

Turning now to the third preferred embodiment of the invention shown in FIGS. 6 and 7, there is illustrated a fuseholder for providing both a visual and electrical indication of fuse operation of an indicating-type fuse. It should be noted in conjunction with these drawings, that certain parts may be conveniently omitted, or interchanged with the respective components shown in the illustrations of the first two embodiments of the invention to provide a fuseholder giving only a visual indication of fuse operation. This will be described in detail in the discussion of FIGS. 6 and 7.

As shown in FIG. 6, a fuseholder is shown adapted to receive an indicating-type fuse 162, having a first end ferrule 164, an intermediate insulating body section 166, and a second end ferrule 168, having a first diameter portion 170 and a reduced diameter portion 172, defining a shoulder 174 therebetween. Fuses such as fuse 162 include flag means 176 which extend linearly upon operation of the fuse. As can be seen, flag 176 is biased by a spring 178, which maintains an internal fuse wire or fuse bar under tension. When excess current separates the wire or bar, the spring 178 moves the flag 176 into extended position. Flag 176 is shown as having a first triangular portion 180 and a straight portion 182, here shown conventionally covered with insulation 184. Thus, when the fuse is operated, portion 182 with insulation 184 will protrude through an aperture 186 in a cap portion 188, and triangular portion 180 will contact ring-shaped apertured portion 190 of third contact means 192, to provide an electrical remote indication of fuse operation. If such an indication is not desired, third contact means 192 may be omitted, insert means 34 of first embodiment may be used, and a fourth contact means 194 may be omitted. Thus, the body portion 24 of the first embodiment may be used instead of the body portion illustrated, thus eliminating keying means to be further described below from the body and cap portions, and removing isolating means from the cap portion. Also, a cap portion such as cap portion 188 which includes a portion adapted for manual grasping should be provided, since a design which protrudes a flag means into a screwdriver slot may result in damage to the aperture through which it protrudes when forced back by a screwdriver tip.

Continuing with the description of FIGS. 6 and 7, insert means 34*a* is shown provided with finger 66, tabs 72 and radial projections 68, but with a latching member 196 instead of slots 64 of FIG. 1, and shown as subtending an arc less than a full circle in cross section.

To assemble cap portion 188, apertured portion 190 is placed against interior surface 198, shown in FIG. 7, with linearly-extending portion 200 disposed between isolating means shown as ribs 202 and 204. Edges 206 and 208 of insert number 34*a* are placed on opposite sides of ribs 202 and 204 from linearly-extending portion 200. The outside diameter of apertured portion 190 of third contact means 192 should be less than the inside diameter of insert means 34*a*. Then, a spacer member 212 is inserted inside insert member 34*a*. Spacer member 212 has a first edge 214 adapted to bear against apertured portion 190 and a second edge 216 adapted to bear against shoulder 174 of fuse 162, to properly space flag means 176 from aperture 186 and from apertured portion 190. Cap portion 188 itself includes a tubular body portion 218, and an enlarged head portion 220, having a surface 222 which is adapted to be manually grasped by any conventional means, such as knurling or ribbing. Head portion 220 also includes a portion of the keying means of this embodiment of the invention shown as radial rib 224. This rib cooperates with a slot 226 in flange portion 112*a* of body portion 24*a*. First contact means 30*a* includes a terminal portion 92, and is latched in position by an integral spring means 228 formed in contact area 94*a*. As can be seen, spring 228 is formed by making a spiral notch in member 30*a*, and deforming the notched area to define a helical spring, which can be compressed to the original thickness of member 30*a* for insertion into body 24*a*.

Fourth contact means 194 includes a terminal portion 230 in the form of a conventional quick-connect terminal, and a contact portion 232 having a latching member or finger 234 for cooperating with contact area 236 of third contact means 192. Latching member or finger 234 cooperates with an aperture 118*a* in body portion 24*a* to retain contact means 194. Body portion 24*a* is also provided with a slot 270, similar to slot 126 in shoulder 120, for receiving fourth contact member 194.

Turning now to FIGS. 8–11, there is shown a fuseholder according to the invention for an indicating-type fuse, providing an electrical indication of fuse operation, and with a biasing spring in the cap member. As before, similar numbers are being used for similar features.

In the fuseholder shown in FIGS. 8–11, various changes are made from the fuseholder shown in FIGS. 6 and 7, the most significant ones being the provision of a biasing spring in the cap member, and the deletion of apertures for providing a visual indication of fuse operation. This necessitates a slightly different form of spacer.

Third contact means 192*a* includes a solid contact member to be disposed against interior surface 198, a linearly-extending portion 200 and a contact portion 236 adapted to make electrical contact with fourth contact means 194. At assembly of cap portion 188*a*, third contact means 192*a* would be inserted with solid contact member 242 adjacent surface 198, and followed with a spring 246, which may be either as illustrated or having the configuration of spring means 36 shown in FIG. 1. Then, a spacer means 248 would be inserted, and followed by the insertion of insert 34*a*. A protrusion 250 on insert 34*a* indicates that the full desired depth of insertion has been achieved.

As illustrated, spacer means 248 has an inside diameter appropriate to receive reduced diameter portion 172 of indicating-type fuse 162, and an end portion 252 adapted to bear against shoulder 174. Distal to end portion 252, spacer 248 has an enlarged outside diameter portion 254, defining a shoulder 256 between enlarged outside diameter portion 254 and a portion 258 adjacent end portion 252. Spacer means 248 also includes a flange end portion 260 surrounding a central aperture 262, for receiving straight portion 182 of flag 176 therethrough. The dimensions of flange end portion 260 are selected appropriately for cooperation with spring means 246.

As before, base portion 24*a* is assembled by inserting first contact means 30 into slot 130, inserting second contact means 32 into slot 126, which is aligned with a clearance groove 264, shown as extending to face portion 266. A second clearance groove 268 is provided, also extending to face 266, should it be desirable to utilize a second second contact means 32. Fourth contact means 194 is inserted through a slot 270, formed in shoulder 120, in alignment with a clearance groove 272, also shown as extending to face portion 266.

Figure 9:
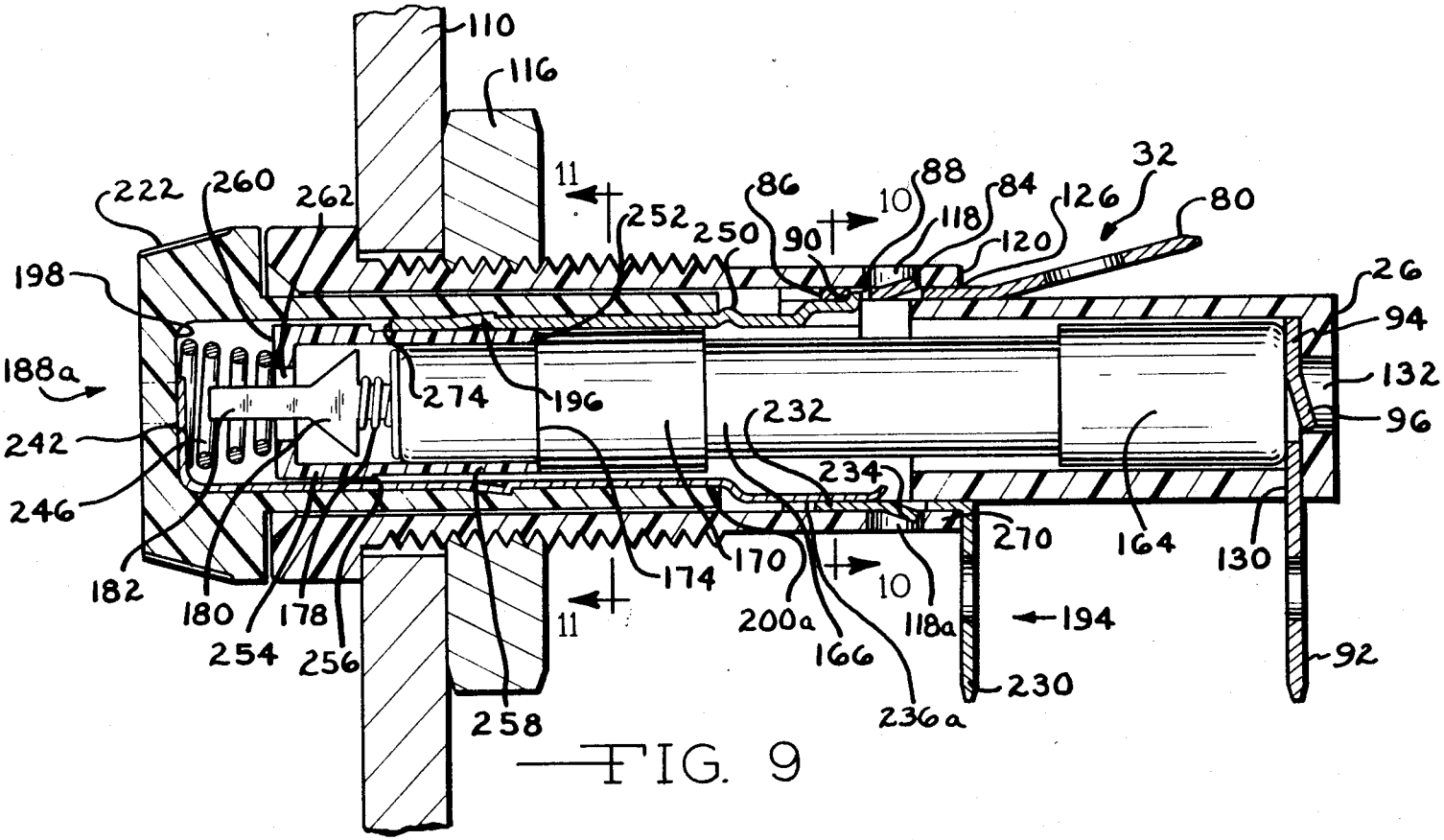
FIG. 9 shows a lengthwise sectional view of the fuseholder of FIG. 8, taken along line 9—9 in FIG. 10.

In the assembled sectional view shown in FIG. 9, it can be seen that shoulder 256 of spacer means 248 cooperates with a leading edge 274 of insert 34*a*, so that insert 34*a* retains spacer means 248 and spring means 246 in cap portion 188*a*.

Figure 10:
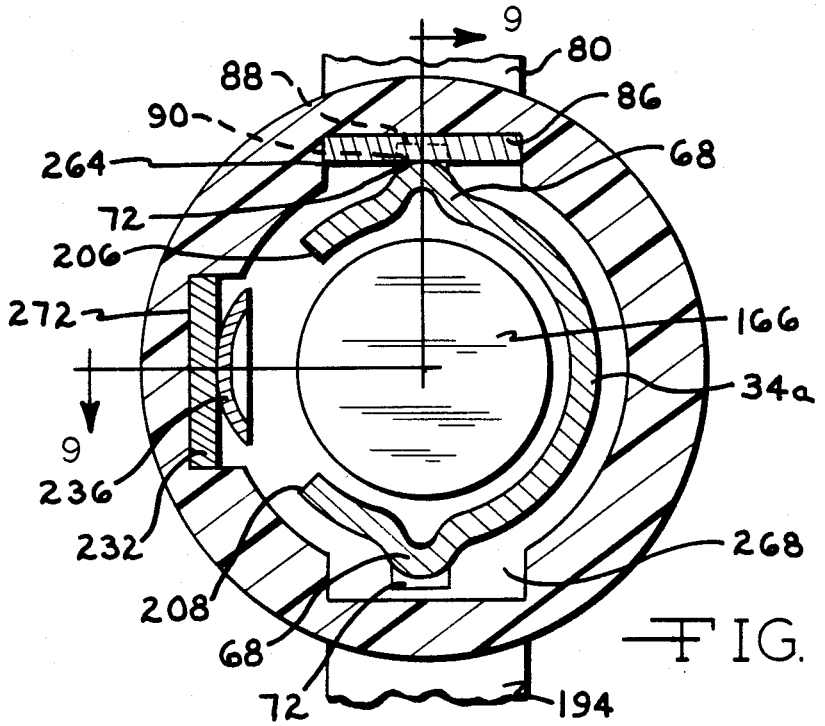
FIG. 10 shows a transverse sectional view of the fuseholder of FIG. 9, taken along line 10—10 in FIG. 9.

FIG. 10 shows the sectional line along which the view in FIG. 9 is taken, and illustrates the interengagement between second contact means 32 with radial projection 68 and radially-projecting tab means 72, and the interengagement of contact portion 236 of third contact means 192 and contact portion 232 of fourth contact means 194.

Figure 11:
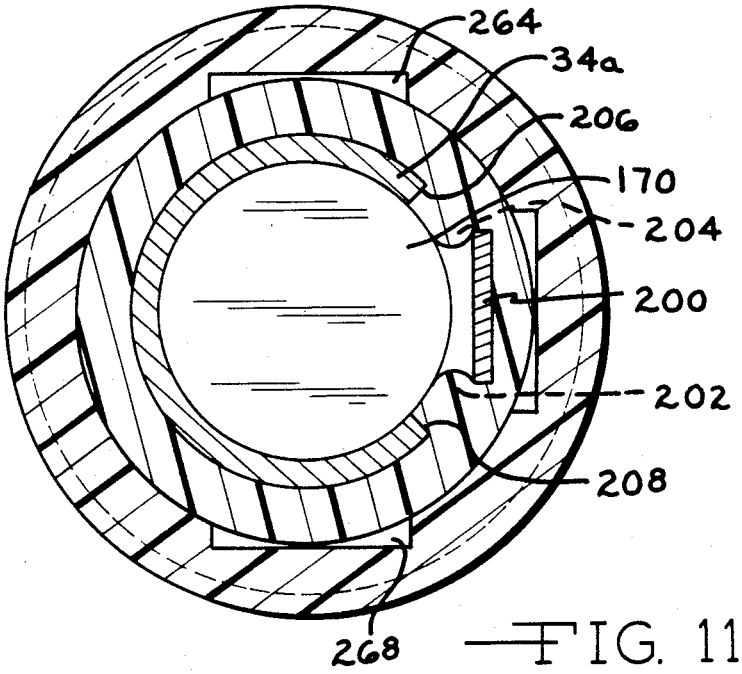
FIG. 11 shows a transverse sectional view of the fuseholder of FIG. 9, taken along line 11—11 in FIG. 9.

Turning to the sectional view of FIG. 11, which is taken in a direction reverse to the direction of the view of FIG. 10, it may be seen that, if third contact means 192 is inserted into cap portion 188*a* while the insulating plastic of which it is made is sufficiently warm, sufficient plastic flow may occur so that linearly-extending portion 200 may become embedded between ribs or isolating means 202 and 204, enhancing the retention of third contact means 192. However, preferably, contact means 192 is inserted at room temperature.

Figure 12:
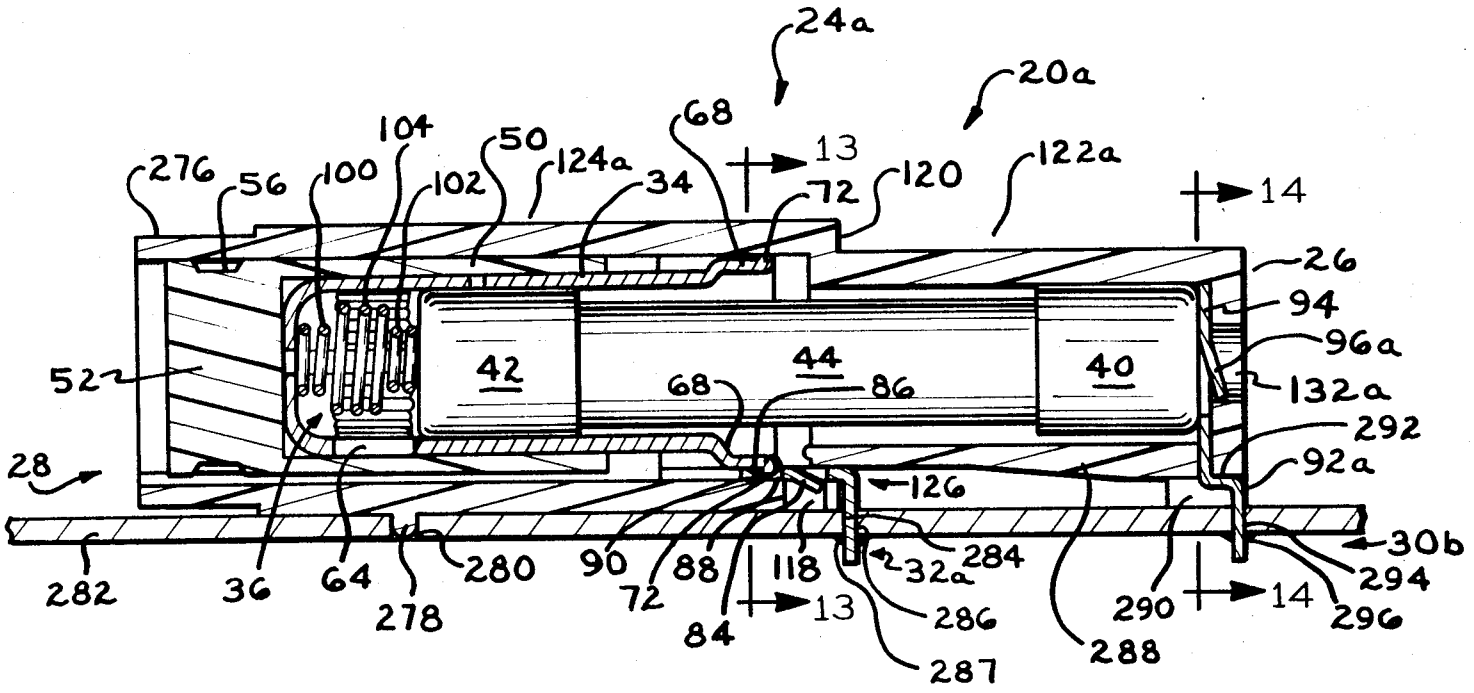
FIG. 12 shows a lengthwise sectional view of a fuseholder according to a fifth embodiment of the invention, adapted to be mounted on a printed circuit board.
Figure 13:
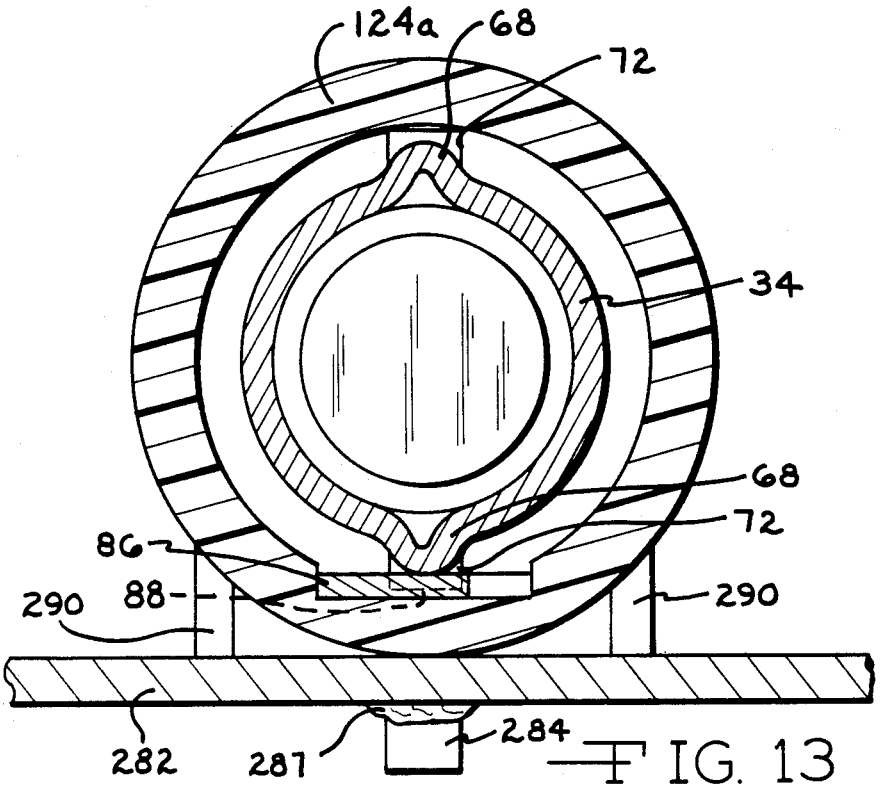
FIG. 13 shows a transverse sectional view of the fuseholder of FIG. 12, taken along line 13—13 in FIG. 12.
Figure 14:
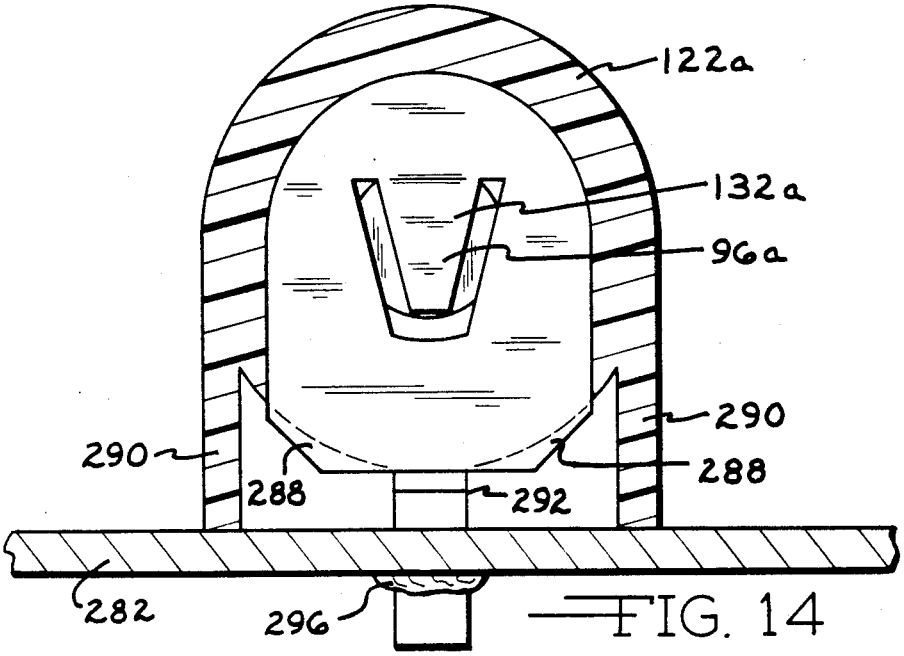
FIG. 14 shows a transverse sectional view of the fuseholder of FIG. 12, taken along line 14—14 in FIG. 12.

Turning now to FIGS. 12–14, there is shown a fuseholder according to a fifth preferred embodiment of the invention, adapted for mounting to a mounting surface such as a printed circuit board, and including many elements in common with the previously-described embodiments, particularly the embodiment shown in FIGS. 1–4. It is also adaptable to retain a miniature fuse, as shown in FIG. 5, or to receive an indicating-type fuse.

As shown in FIG. 12, second larger portion 124*a* of body portion 24*a* has a reduced diameter exterior clearance portion 276 adjacent second open end 28, and is provided with a radially-projecting locating pin 278 adapted to cooperate with a locating aperture 280 formed in a printed circuit board 282. A second contact means 32*a* includes a terminal portion 284 bent at substantially a right angle to tip portion 86, and adapted to pass through an aperture 286 in printed circuit board 282 for connection to printed circuit wiring by soldering or the like as at 287. First portion 122*a* of body portion 24*a* is provided with an enlarged portion 288 and feet portions 290, to stabilize fuseholder 24*a* on printed circuit board 282. A first contact member 30*b* is provided, and is formed with an offsetting bend at portion 292, to pass through an aperture 294 in printed circuit board 282 and be connected to printed wiring such as by soldering at 296. Also, as shown at FIG. 14, latching finger 96*a* may be configured as a truncated triangle, rather than as the rectangular portion shown most clearly in FIG. 4, for cooperating with a circular aperture 132*a*. Also, aperture 132*a* need not necessarily pass entirely through first closed end 26, but may be a circular depression. This is advantageous for use on printed circuit boards, since they are often coated with a conformal coating and insulating compound, or washed with a flux solvent after soldering, so that an unsealed aperture might permit entry of these compounds. The remaining apertures and slots may be conveniently sealed such as by a sealant or resilient mounting pad placed on printed circuit board 282, and a sealing O-ring may be placed in groove 56, if desired.

As will be apparent, numerous variations and modifications of the five disclosed embodiments of the invention are possible, and may be easily made by one skilled in the art without departing from the spirit and scope of the invention.

I claim:

1. A fuseholder for holding and making electrical contact with a tubular fuse element having first and second end ferrules and an insulating body intermediate said first and second end ferrules, comprising:

a cap portion;

a body portion having a first closed end and a second open end, said second open end being adapted to receive and removably retain said cap portion;

said body portion including first electrically-conductive contact means adjacent said first closed end for establishing electrical connection to said first end ferrule;

said cap portion including electrically-conductive insert means for establishing electrical connection to said second end ferrule;

said insert means including at least one radial projection adjacent an open end thereof, said insert means further including a radially-projecting tab means adjacent said radial projection;

said body portion including second contact means for establishing electrical connection to said insert means, said second contact means including a terminal portion and a tip portion and defining a notch therebetween;

said notch being adapted to receive said radially-projecting tab means of said insert means, said tip portion being adapted to maintain electrical connection between said tip portion and said radial projection of said insert means when said radially-projecting tab means is received in said notch.

2. A fuseholder according to claim 1, wherein:

said insert means includes spring means for urging said radially-projecting tab means against a first edge of said notch, said first edge being proximal to said tip portion of said second contact means.

3. A fuseholder according to claim 2, wherein:

said spring means is a helical spring having a first end portion, an intermediate portion and a second end portion;

said first end portion and said second end portion having a first outside diameter, said intermediate portion having a second outside diameter substantially greater than said first outside diameter.

4. A fuseholder according to claim 2, wherein:

said fuseholder being adapted to receive an international standard fuse;

said cap portion including adapter means disposed in part within said insert means and having a first diameter portion adapted to be closely received within said insert and a second diameter portion smaller in diameter than said first diameter portion adapted to closely receive said second ferrule.

5. A fuseholder according to claim 1, wherein:

said fuseholder being adapted to receive a mechanical indicating fuse means therein and provide a visible indication of operation of said indicating fuse;

said indicating fuse having flag means linearly-extensible from said second end ferrule upon operation of said fuse means;

said second end ferrule including a reduced diameter portion and a larger diameter portion adjacent said insulating body;

said reduced diameter portion and said larger diameter portion defining a shoulder therebetween;

said cap portion including a spacer member for spacing said shoulder from an interior end surface of said cap portion;

said second contact means including spring means for urging said shoulder against said spacer member and urging said radially-projecting tab means against a first edge of said notch, said first edge being proximal to said tip portion of said second contact means;

said cap defining an aperture therethrough for receiving said flag means therethrough upon operation of said fuse element.

6. A fuseholder according to claim 5, wherein:

said fuseholder being further adapted to provide an electrical indication of the operation of said fuse element;

said cap portion including third contact means, said third contact means including a first apertured portion disposed ajacent an end interior surface of said cap portion, said apertured portion being aligned with said aperture defined through said cap portion for allowing the passage of a portion of said flag means therethrough, a second portion of said flag means contacting said apertured portion upon operation of said fuse element;

said third contact means further including a linearly-extending portion electrically isolated from said insert means; and said body portion including fourth contact means, said fourth contact means including a first terminal portion and a second portion disposed to establish electrical connection with said linearly-extending portion when said cap portion is received in said body portion.

7. A fuseholder according to claim 1, wherein:

said fuseholder being adapted to receive a mechanical-indicating fuse means therein and provide an electrical indication of operation of said indicating fuse means;

said indicating fuse means having conductive flag means linearly-extensible from said second end ferrule upon operation of said fuse and electrically connected to said second end ferrule upon operation of said fuse means;

said second end ferrule including a reduced diameter portion and a larger diameter portion adjacent said insulating body;

said reduced diameter portion and said larger diameter portion defining a shoulder therebetween;

said cap portion including third contact means, said third contact means including a first portion disposed adjacent an end interior surface of said cap portion and further including a linearly-extending portion electrically isolated from said insert means;

said body portion including fourth contact means, said fourth contact means including a first terminal portion and a second portion disposed to establish electrical connection with said linearly-extending portion when said cap portion is received in said body portion;

said cap portion including spring means and insulating spacer means, said spacer means being adapted to bear against said shoulder, said spring being interposed between said end interior surface for urging said first end ferrule towards said first electrically-conductive contact means and for urging said radially-projecting tab means against a first edge of said notch proximal to said tip portion of said second contact means.

8. A fuseholder according to claim 6, wherein:

said fuseholder includes key means for limiting rotation of said cap portion and said body portion when said cap portion approaches said body portion to align said radially-projecting tab means with said second contact means and to align said linearly-extending portion of said third contact means and said second portion of said fourth contact means.

9. A fuseholder according to claim 7, wherein:

said fuseholder includes key means for limiting rotation of said cap portion and said body portion when said cap portion approaches said body portion to align said radially-projecting tab means with said second contact means and to align said linearly-extending portion of said third contact means and said second portion of said fourth contact means.

* * * * *